US005408765A

United States Patent [19]

Lozensky

[11] Patent Number: 5,408,765

[45] Date of Patent: Apr. 25, 1995

[54] REMOVAL AND MOUNTING APPARATUS FOR SNOWPLOWS

[76] Inventor: Charles A. Lozensky, 14 Charles Rd., Catskill, N.Y. 12414

[21] Appl. No.: 82,036

[22] Filed: Jun. 25, 1993

[51] Int. Cl.[6] ..... E01H 5/04

[52] U.S. Cl. ..... 37/231; 37/270; 172/240

[58] Field of Search ..... 37/266, 270, 271, 231, 37/235, 236; 172/832, 834, 387, 388, 286, 287, 799.5, 240, 244; 280/93, 414.2, 63, 47.131

[56] References Cited

U.S. PATENT DOCUMENTS

| | | | |
|---|---|---|---|
| 2,094,515 | 9/1937 | Abbe | 37/270 X |
| 2,598,831 | 7/1950 | Ramey | 280/414.2 X |
| 2,624,591 | 1/1953 | Choplin | 280/63 |
| 2,953,387 | 9/1960 | Portner | 280/471.131 |
| 3,160,215 | 12/1964 | Harrell | 172/832 |
| 3,252,716 | 5/1966 | Gaterman | 37/236 X |
| 3,463,505 | 8/1969 | German et al. | 280/79.2 |
| 3,845,577 | 11/1974 | Naymik | 37/270 X |
| 4,528,762 | 7/1985 | Sarka et al. | 37/236 |
| 4,887,838 | 12/1989 | Reppen | 280/656 |
| 5,129,170 | 7/1992 | Fusilli | 37/231 |

*Primary Examiner*—Dennis L. Taylor
*Assistant Examiner*—Victor Batson
*Attorney, Agent, or Firm*—Charles J. Brown

[57] ABSTRACT

Removal and mounting apparatus for a snowplow assembly wherein wheel assemblies are removably clamped to the blade lower edge so that the plow assembly may be easily manually wheeled about and maneuvered for positioning during removal and mounting.

6 Claims, 2 Drawing Sheets

REMOVAL AND MOUNTING APPARATUS FOR SNOWPLOWS

BACKGROUND OF THE INVENTION

Those who have mounted a conventional snowplow assembly on the forward support of a drive vehicle recognize the difficulty of the task. A rearwardly extending frame of the plow assembly has connector holes which must be aligned with matching holes in the forward support of the drive vehicle, so that spring-biased locking pins may thrust through the aligned pairs of holes. This requires that the rigid rearward frame of the heavy plow assembly be elevated to the correct position, adjusted laterally side-to-side, and even displaced angularly before the locking pins can slide home. It can be an aggravating and physically demanding operation carried out often under conditions of extreme cold and poor lighting.

No apparatus has heretofore been provided for effectively assisting in the removal and mounting of a snowplow assembly on the front end of the drive vehicle. Those examples of prior art where wheels are mounted on snowplow blades or frames are limited to functioning as casters which simply roll along the ground during plowing to maintain the lower edge of the blade at the proper slight elevation above the plowed surface. Examples of such wheels on snowplows are disclosed in U.S. Pat. Nos. 2,420,591, 2,431,410, 3,466,766 and 4,905,387 and in Austrian Patent No. 222,164. A related use of wheels on a snowplow is disclosed in U.S. Pat. No. 4,865,373.

In environments other than snowplows it is known to provide removable wheeled dollies or carriages particularly for boats, as disclosed for example in U.S. Pat. Nos. 3,831,211, 4,601,481, 4,615,534 and 5,072,959. A related wheeled assembly in the nature of a trailer is disclosed in U.S. Pat. No. 3,829,115.

None of these prior art structures permits a person to remove a snowplow from a drive vehicle and mount it again in a manner which avoids the many difficulties inherent in that operation mentioned above. It is the principal object of the present invention to provide removal and mounting apparatus for a plow assembly which allows the heavy and unwieldy plow assembly to be moved manually in the manner of a live weight, which is to say a weight partly suspended and partly on a wheeled support such that it can be moved forwardly and rearwardly, upwardly and downwardly and even angularly, with very little manual effort to align the plow assembly frame easily and quickly with the drive vehicle supports so that the locking pins can easily find their place.

SUMMARY OF THE INVENTION

The invention comprises a snowplow assembly having a forward blade with a lower scraping edge and a rearward frame removably attachable to a forward support and to a blade lifting device on a drive vehicle, all in combination with removal and mounting apparatus for the plow assembly. Clamps are provided which define respective seats to fit removably under and about the lower blade edge at respective opposite end portions thereof. Extending laterally from each clamp is an axle with respective outer hub portions beyond the respective opposite end portions of the blade edge. Wheels are rotatably mounted on the respective hub portions. Fixed on the rearward frame of the snowplow assembly is a lift anchor and a connector for removable attachment between the lift anchor and the blade lifting device on the drive vehicle.

By this apparatus during removal of the snowplow assembly from the drive vehicle the blade lower edge is removably fitted into the clamp seats and the blade is then lowered so that the wheels are on the ground. The plow rearward frame is then detached from the forward support and blade lifting device of the drive vehicle permitting the snowplow assembly to be manually wheeled away. Also as a consequence of this apparatus, during mounting of the snowplow assembly it may be manually wheeled into position so that the connector can be attached between the lift anchor and the blade lifting device. Upon operation of the lifting device the assembly may be manually guided on its wheels for attachment to the forward support of the drive vehicle whereupon the connector is removed so that the blade lifting device can be attached to the rearward frame and the blade raised to lift the wheels from the ground permitting removal of the clamps and wheels from the blade lower edge.

Preferably a pair of clamps are provided for each of the respective end portions of the lower blade edge, each clamp defining a U-shaped seat portion for the blade edge and a transverse hole for receiving the associated axle. Set screw means are preferably provided in each U-shaped seat portion in each clamp for securing the clamp to the blade edge. Each pair of clamps at each end portion of the blade edge may have its own separate axle extending therefrom. The connector may include an extension spring permitting some vertical movement of the frame without operation of the blade lifting device to assist in attachment of the rearward frame to the drive vehicle forward support and also to allow resilient extension of the connector if the rearward frame becomes snagged during attachment to the drive vehicle.

DESCRIPTION OF PREFERRED EMBODIMENT

Figure 1:
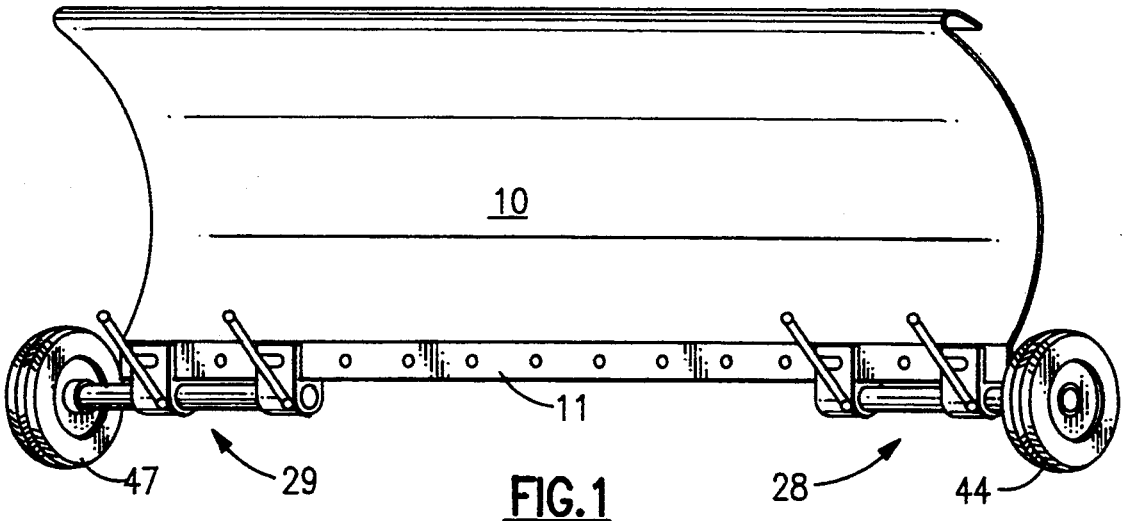
FIG. 1 is a perspective view of the blade end of a snowplow assembly looking rearwardly and showing the respective pairs of clamps, axles and wheels at opposite end portions of the lower edge of the blade.

Referring to FIG. 1 a conventional curved snowplow blade 10 is shown with a lower scraping edge 11. The blade 10 is typically mounted on a rearward frame 13, a portion of which is visible in FIG. 2. In many conventional snowplow assemblies hydraulically actuated blade angling means are provided operated from the cab of the associated drive vehicle, by which the blade 10 may be turned to the left or right of the centerline of the frame 13 or perpendicular to it. Such angling equipment forms no part of the invention and is not shown in the drawings. The lower scraping edge 11 may be thicker than the remainder of the blade 10 and reinforcing gussets, not shown, may be provided on the rear side of the blade 10 to increase its strength.

Figure 2:
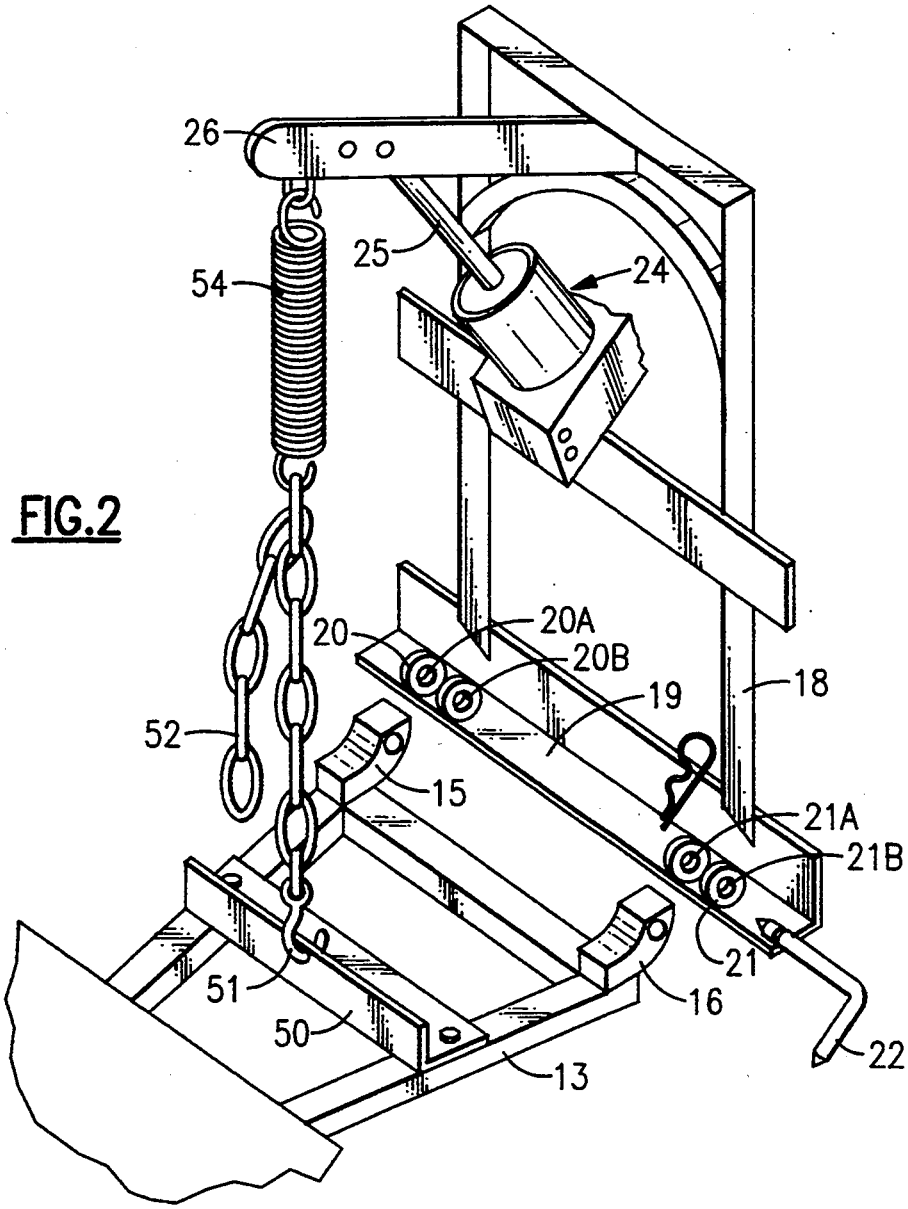
FIG. 2 is a perspective view of the rearwardly extending frame of the snowplow assembly illustrating the lift anchor and connector for assisting in mounting the plow assembly.

In a typical snowplow assembly such as that shown, a pair of lugs 15 and 16 visible in FIG. 2 are mounted on the rearwardmost portion of the frame 13 and have aligned locking holes. Mounted on the drive vehicle is a forward support 18 which includes a lower horizontal angle iron 19 to which are welded two pairs of ears 20 and 21 formed with aligned holes 20A and B and 21A and B respectively for receiving locking pins. Only the locking pin 22 associated with the ears 21 is shown. The locking pin 22 may typically be spring-biased so that it thrusts itself into locking position when the holes in the lugs 15 and 16 are correctly aligned with the holes in the ears 20 and 21.

A hydraulic hoist system including a cylinder 24, piston rod 25 and lever arm 26 is mounted on the support 18 on the driving vehicle. This hydraulic hoist is also operated from the cab of the driving vehicle. At the outer end of the lever arm 26 a length of chain may be affixed to extend downwardly to a suspension point on the plow assembly frame close to the rear face of the blade 10. That length of chain and suspension point are not shown in the drawings. In conventional operation the lower scraping edge of the blade 10 may be raised or lowered with respect to ground by operation of the hydraulic hoist to lift and lower the plow assembly at that suspension point.

A typical sequence of steps in mounting a conventional plow assembly of the kind disclosed on a drive vehicle is generally as follows: The rear of the frame 13 is left resting on the ground and the vehicle is driven forwardly until the ears 20 and 21 are approximately over and near the lugs 15 and 16. The rearward end of the frame 13 is then manually lifted to an elevation where the lugs 15 and 16 are approximately coplanar with the ears 20 and 21. The locking pins 22 are pulled into unlocked position and the difficult part of the procedure begins. It is not possible to drive the vehicle such that the lugs 15 and 16 move into place between the ears 20 and 21. Instead the operator must manually push the entire plow assembly angularly so that the lugs 15 and 16 are equally spaced from their respective ears 20 and 21. Then last vertical adjustments on the height of the lugs 15 and 16 must be made by manual lifting of the frame 13. Finally the lugs 15 and 16 must be advanced between the ears 20 and 21 by manually pushing and tugging the entire plow assembly rearwardly with the blade edge 11 sliding on the ground. Upon completion of all that the locking pins 22 may finally be thrust through the aligned holes 20A and B and 21A and B to secure the lugs 15 and 16.

To avoid these difficult procedures the present invention provides two matching clamp-axle-wheel assemblies 28 and 29, one for each edge portion of the lower edge 11 of the blade 10 as shown in FIG. 1. The right assembly 28 is described in detail and it is to be understood that the left assembly 29 is its mirror image.

Figure 3:
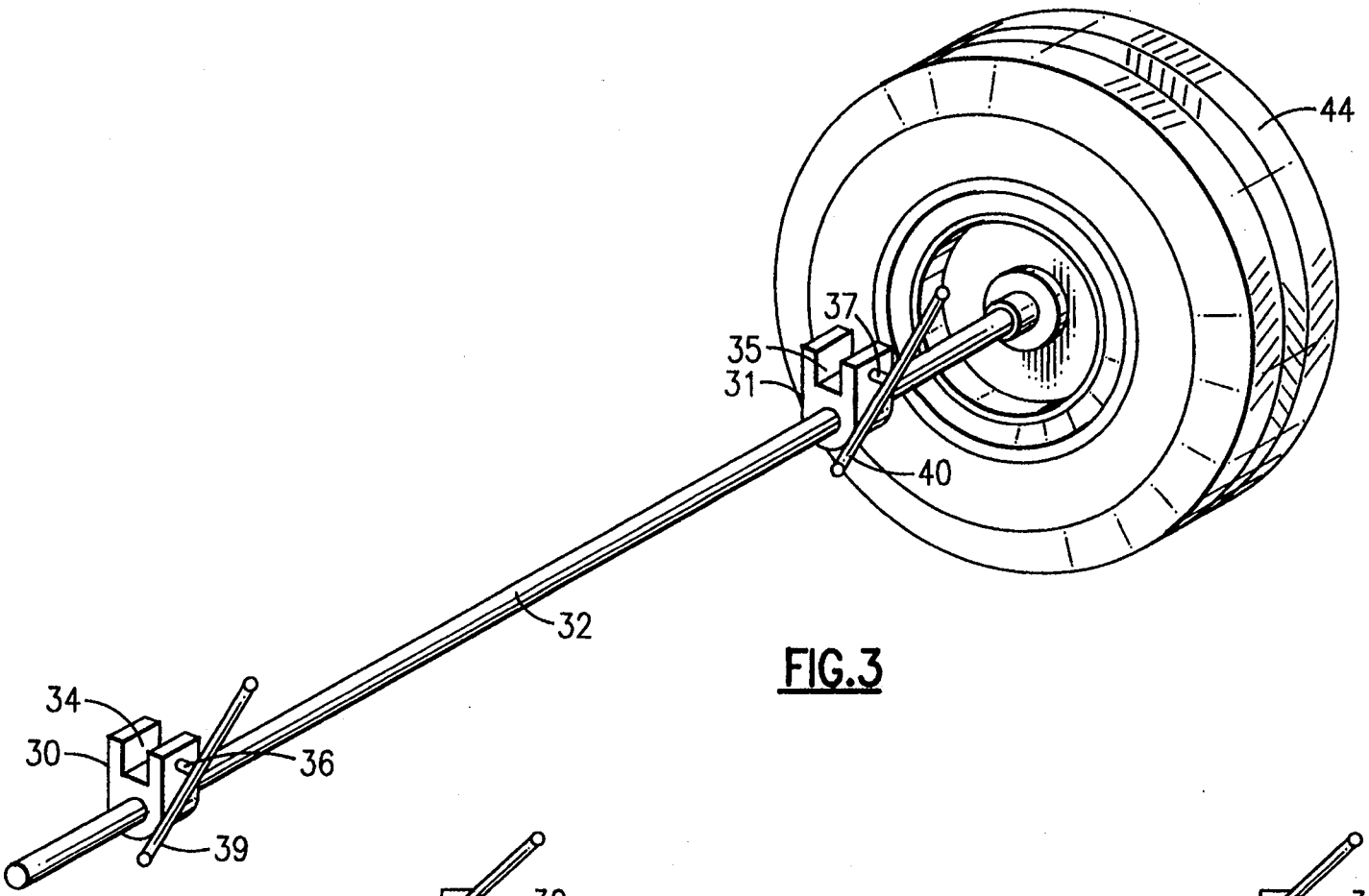
FIG. 3 is an enlarged perspective view of one of the pairs of clamps on its own separate axle on which the associated wheel is mounted, all removed from the snowplow blade.
Figure 4:
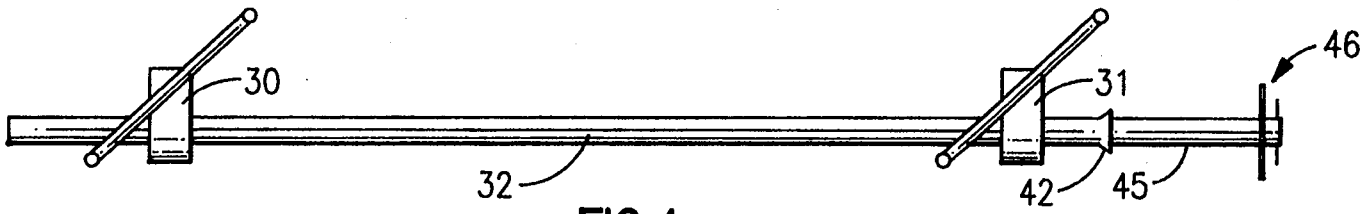
FIG. 4 is an elevation of the axle and clamps of FIG. 3 with the wheel removed.

Referring to FIGS. 3 and 4 the assembly 28 includes two U-shaped clamps 30 and 31 formed with coaxial transverse holes through which an axle 32 extends. The clamps 30 and 31 may be cast directly on the axle 32 so as to be rigidly affixed thereto. Respective seats 34 and 35 are thus formed in the clamps 30 and 31, both being sized and configured to fit around and support the lower edge 11 of the blade 10. A set screw 36 extends through one arm of the U-shaped clamp 30 and a set screw 37 extends through a similar arm of the U-shaped clamp 31. These set screws may be turned manually without tools by permanently attached T-handles 39 and 40 respectively. The set screws are of hardened steel and cut into the softer metal of the snowplow blade edge 11 when the T-handles 39 and 40 are forcibly turned.

Referring to FIG. 4 a hub shoulder 42 is cast integrally in the axle 32 outwardly from the outward clamp 31. A wheel 44 is mounted on a hub portion 45 of the axle 32 abutting the shoulder 42 and may be secured in place by appropriate washers and cotter pins 46. A wheel 47 on the other assembly 29 is similarly mounted on the opposite end of the blade edge portion 11.

Turning again to FIG. 2 a lift anchor 50 is provided, for example in the form of an optional angle iron affixed to the rearward frame 13, having a central hole to receive a hook 51 on a short length of chain 52. At the end portion of the chain 52 remote from the hook 51 the chain is secured to one hook end of an extension spring 54, the other hook end of which is secured to the outer end of the lever arm 26 of the hydraulic hoist. The lift anchor 50 is physically located rearward of the suspension point (not shown) to which the lever arm 26 is conventionally connected during operation of the plow. The chain 52 and the extension spring 54 are together referred to herein as a connector between the lift anchor 50 and the blade lifting hoist.

In contrast to the demanding mounting and removal process described above for conventional snowplow assemblies, the sequence of steps for the improved plow assembly of the invention is simple, quick and relatively effortless. The process will be described first with removal of the plow assembly.

The lower edge 11 of the blade 10 is lifted from the ground by operation of the hydraulic hoist acting through the suspension point on the rearward frame of the plow assembly. The right wheel assembly 28 is quickly attached simply by lifting the clamps 30 and 31 up beneath the plow blade 10 so that the lower edge 11 of the blade fits within the seats 34 and 35. The T-handles 39 and 40 are then turned to secure the wheel assembly 28 to the right edge portion of the lower scraping blade 11 by means of the set screws 36 and 37. The process is repeated by attachment of the left assembly 29 with its wheel 47 as shown in FIG. 1.

The hydraulic hoist is then operated to lower the wheels 44 and 47 into contact with the ground and the lifting chain connected to the lever arm 26 is detached from the suspension point on the plow assembly. The operator may then manually pick up the rearward end of the frame 13 and easily roll the plow assembly to wherever it is intended to be located while not in use.

In the mounting process the drive vehicle is driven to the general vicinity of the plow assembly and the plow assembly is then easily wheeled manually towards the vehicle. The connector comprising the chain 52 and its extension spring 54 is then attached between the lift anchor 50 and the lever arm 26. The hydraulic hoist is then operated to bring the lugs 15 and 16 to the approximate elevation of the ears 20 and 21. If for some reason the lugs 15 or 16 snag on the angle iron 19 or any other part of the vehicle there is no danger of breakage of parts because the extension spring 54 simply elongates to absorb that added force until the snagging can be corrected. The entire plow assembly is a live weight at this point, which is to say it is supported on the easily rollable wheels 44 and 47 and suspended through the extension spring 54. There is little effort required for the operator then to roll the rearward end of the plow assembly frame forwardly and rearwardly, upwardly and downwardly and even angularly until the lugs 15 and 16 are in proper alignment between the ears 20 and 21. Fine vertical positioning of the lugs 15 and 16 may be done manually by pushing the frame 13 downwardly so as to stretch the extension spring 54. When everything is aligned the locking pins then thrust into locked position. The connector comprising the chain 52 and the extension spring 54 is disconnected and set aside and the suspension chain is connected between the outer end of the lever arm 26 and the standard suspension point on the plow assembly frame.

Actual experience has demonstrated that with the removal and mounting apparatus of the invention described above a plow assembly may be removed from and mounted on a drive vehicle with vastly less physical effort than is demanded with conventional means.

The scope of the invention is to be determined by the following claims rather than by the preferred embodiment of the invention described above.

I claim:

1. In combination with a snowplow assembly having a forward blade with a lower scraping edge and a rearward frame removably attachable to a forward support and to a blade lifting device on a drive vehicle at a certain hoist point on the rearward frame, removal and mounting apparatus for the plow assembly comprising a) clamps defining respective seats to fit removably under and about the lower blade scraping edge at respective opposite end portions thereof, b) an axle extending laterally from each clamp with respective outer hub portions beyond said respective opposite end portions of the lower blade scraping edge, c) wheels rotatably mounted on the respective axle hub portions, d) a lift anchor fixed on the rearward frame of the snowplow assembly and located rearwardly of said hoist point on the rearward frame where the lift anchor is removably attachable to the blade lifting device, e) a connector removably attachable between the lift anchor and the blade lifting device on the drive vehicle, f) whereby during removal of the snowplow assembly from the drive vehicle the lower blade scraping edge is removably fitted into the clamp seats and the blade is then lowered so that the wheels are on the ground and the plow rearward frame is then detached from both the forward support and blade lifting device of the drive vehicle permitting the snowplow assembly to be manually wheeled away, and also g) whereby during mounting of the snowplow assembly it may be manually wheeled into position so that the connector is attached between the lift anchor and the blade lifting device and upon operation of the lifting device the assembly may be manually guided on its wheels for attachment of its rearward frame to the forward support of the drive vehicle whereupon the connector is removed so that the blade lifting device can be attached to the rearward frame and the blade raised to lift the wheels from the ground permitting removal of the clamps and wheels from the lower blade scraping edge.

2. Snowplow removal and mounting apparatus according to claim 1 wherein a pair of clamps are provided for each of the respective opposite end portions of the lower blade scraping edge, each clamp defining a U-shaped seat portion for said blade edge and a transverse hole for receiving the associated axle.

3. Snowplow removal and mounting apparatus according to claim 2 wherein set screw means are provided in each U-shaped seat portion of each clamp for securing the clamp to the blade scraping edge.

4. Snowplow removal and mounting apparatus according to claim 2 wherein each pair of clamps at each end portion of the blade scraping edge has its own separate axle extending therefrom.

5. Snowplow removal and mounting apparatus according to claim 1 wherein the connector includes an extension spring permitting some vertical movement of the rearward frame without operation of the blade lifting device to assist in attachment of the rearward frame to the drive vehicle forward support and also to allow resilient extension of the connector if the rearward frame becomes snagged during attachment to the drive vehicle.

6. In combination with a snowplow assembly having a forward blade with a lower scraping edge and a rearward frame removably attachable to a forward support and to a blade lifting device on a drive vehicle at a certain hoist point on the rearward frame, removal and mounting apparatus for the plow assembly comprising a) a pair of clamps for each of the respective opposite end portions of the lower blade scraping edge, each clamp defining a U-shaped seat portion for the blade edge and a transverse hole for receiving the associated axle;

b) set screw means in each U-shaped portion of each clamp for securing the clamp to the blade edge;

c) separate axles extending from the transverse hole of each pair of clamps with respective outer hub portions beyond said respective opposite end portions of the blade edge;

d) wheels rotatably mounted on the respective axle hub portions;

e) a central lift anchor fixed on the rearward frame of the snowplow assembly and located rearwardly of said hoist point on the rearward frame where the lift anchor is removably attachable to the blade lifting device;

f) a connector removably attachable between the lift anchor and the blade lifting device on the drive vehicle and including an extension spring permitting some vertical movement of the rearward frame without operation of the blade lifting device to assist in attachment of the rearward frame to the drive vehicle forward support and also to allow resilient extension of the connector if the rearward frame becomes snagged during attachment to the drive vehicle;

g) whereby during removal of the snowplow assembly from the drive vehicle the lower blade scraping edge is removably fitted into the clamp seats and the blade is then lowered so that the wheels are on the ground and the plow rearward frame is then detached from both the forward support and blade lifting device of the drive vehicle permitting the snowplow assembly to be manually wheeled away, and also h) whereby during mounting of the snowplow assembly it may be manually wheeled into position so that the connector is attached between the lift anchor and the blade lifting device and upon operation of the lifting device the assembly may be manually guided on its wheels for attachment of its rearward frame to the forward support of the drive vehicle whereupon the connector is removed so that the blade lifting device can be attached to the rearward frame and the blade raised to lift the wheels from the ground permitting removal of the clamps and wheels from the lower blade scraping edge.

* * * * *